United States Patent [19]

Hochmuth

[11] Patent Number: 4,480,557

[45] Date of Patent: Nov. 6, 1984

[54] STEAM GENERATOR WITH INTEGRAL DOWN-DRAFT DRYER

[76] Inventor: Frank W. Hochmuth, P.O. Box 186, Brewer, Me. 04412

[21] Appl. No.: 523,375

[22] Filed: Aug. 15, 1983

Related U.S. Application Data

[63] Continuation-in-part of Ser. No. 333,834, Dec. 23, 1981, abandoned.

[51] Int. Cl.[3] ..... F23B 7/00

[52] U.S. Cl. ..... 110/234; 110/102; 110/118; 110/224; 110/244; 110/256

[58] Field of Search ..... 110/102, 105, 108, 118, 110/234, 244, 245, 256, 224, 346

[56] References Cited

U.S. PATENT DOCUMENTS

| | | | |
|---|---|---|---|
| 2,483,728 | 10/1949 | Glaeser | 110/244 |
| 2,925,055 | 2/1960 | Miller et al. | 110/105 |
| 3,168,074 | 2/1965 | Kuhner et al. | 110/234 |
| 3,893,426 | 7/1975 | Bryers | 110/245 |
| 4,213,405 | 7/1980 | Lis et al. | 110/234 |
| 4,249,472 | 2/1981 | Mitchell | 110/245 |
| 4,279,222 | 7/1981 | Pearce | 110/245 |
| 4,397,267 | 8/1983 | Fink | 110/245 |

*Primary Examiner*—Edward G. Favors
*Assistant Examiner*—Steven E. Warner
*Attorney, Agent, or Firm*—W. R. Hulbert

[57] ABSTRACT

A steam generating furnace which burns high moisture content fuel has a panel of heat absorbing tubes dividing it into two vertical interconnecting passageways: (a) a combustion chamber for burning the predried fuel and (b) a drying shaft for extracting moisture from the fuel. Wet fuel is introduced near the top of the drying shaft. As it falls it is dried by some of the hot gases diverted from the top of the combustion chamber into the top of the drying shaft. The cooling of the hot combustion gases due to evaporation of moisture from the wet fuel causes a difference in density between the gases in the two passageways, creates a natural, unidirectional circulation of part of the combustion gases from the top of the combustion chamber to the drying shaft. Predrying the wet fuel causes the fuel to burn faster and hotter thereby producing a stable and efficient combustion of the wet fuel at higher specific combustion rates. Recirculation of the cooled drying gas through the combustion chamber reduces the generation and emission of particulate and gaseous pollutants.

6 Claims, 5 Drawing Figures

STEAM GENERATOR WITH INTEGRAL DOWN-DRAFT DRYER

This is a continuation-in-part of application, Ser. No. 333,834, filed Dec. 23, 1981, and abandoned.

BACKGROUND OF THE INVENTION

This invention relates to a steam generating furnace adapted to burn high moisture content fuel and providing novel means and method for pre-drying the fuel as it enters the furnace.

Waste wood, as a by-product of the paper mill industry, has long been burned in furnaces to generate steam. Hogged or waste wood generally has a very high moisture content, being on the order of 50–70% water. In the past, in order to maintain stable burning conditions of waste wood, a secondary fuel such as oil or natural gas has been necessary. In recent years, as these fuels have become scarcer and more expensive, ways have been sought for burning wet waste wood with a minimum use of secondary fuels. Pre-drying the wood helps in this regard, causing it to burn faster and hotter with greater stability, higher efficiency and higher specific combustion rates.

One present means of drying high moisture fuel prior to burning it is to introduce it into the upper portion of a furnace, so that some of the moisture is removed as it falls downwardly through the furnace onto a grate at the bottom. Such an arrangement is shown in Glaeser, U.S. Pat. No. 2,483,728, and in Wood, U.S. Pat. No. 1,427,045. A major disadvantage of this arrangement is that the unburned fuel and pollutants are emitted from the furnace with the exhaust gases rather than being retained or returned to the furnace for complete combustion.

Fluidized bed furnaces, as described in Bryers, U.S. Pat. No. 3,893,426, are another means which have been used to burn high moisture content fuels. A characteristic of fluidized bed furnaces is that they must be operated at temperatures (1200° F.–1800° F.) significantly lower than those used in traditional combustion furnaces (2200° F.–2400° F.). The present invention is not applicable to fluidized bed furnaces.

It is, accordingly, an object of the invention to provide in a high moisture content fuel burning steam generating furnace of the traditional combustion type a novel means and method for predrying the wet fuel so as to increase the stability and efficiency of burning of the fuel while reducing the generation and release to the atmosphere of particulate and gaseous pollutants.

SUMMARY OF THE INVENTION

According to the invention, there is provided in a steam generating furnace having a combustion chamber comprising a vertical passageway above a fuel supporting grate for upward flow of products of combustion, the following improvement permitting at least partial pre-drying of entering high moisture content fuel.

A second passageway forming a drying shaft is arranged generally parallel to the first-named passageway and sufficiently offset therefrom and from the grate to prevent upward flow therein of products of combustion from the combustion chamber; means establish communication between the upper end portions of the passageways so as to permit some of the upwardly flowing gaseous products of combustion to flow from the combustion chamber into the upper portion of drying shaft; means are provided for introducing high moisture content fuel into the drying shaft near its upper end to fall downwardly therein whereby moisture is evaporated from the fuel thereby cooling and increasing the density of the diverted gases to produce downward gaseous flow therein with the falling fuel so as to dry the latter; means cause lateral deflection of the at least partially dried fuel from the bottom of the drying shaft onto and above the grate, and means permit recirculation of the cooled gases into the lower end of the combustion chamber.

The invention includes the method of at least partially drying high moisture content fuel for burning in a combustion chamber of a steam generating furnace which comprises providing a drying shaft arranged generally parallel to the combustion chamber with openings into the chamber at top and bottom; permitting a portion of the gaseous products of combustion to flow from the top of the combustion chamber into the top of the drying shaft; introducing wet fuel into the shaft; permitting the fuel to fall downwardly within the shaft whereby moisture is evaporated from the fuel thereby cooling the introduced gaseous products so that they become more dense than the gases in the combustion chamber and circulate downwardly by gravity and are recirculated into the bottom of the combustion chamber; and introducing the at least partially dried fuel into the lower end of the combustion chamber from the bottom of said shaft.

In preferred embodiments: the fuel is laterally deflected and distributed into the lower end of the combustion chamber by an inclined distribution shelf positioned near the bottom of the drying shaft above and offset from the grate so the falling fuel that hits the surface thereof is deflected thereby onto the grate; air ports are located above and through the shelf through which air can be introduced for evenly distributing fuel onto and above the grate; a screen can be formed of spaced heat exchange tubes extending across the combustion chamber and burners are located above the screen for burning auxiliary fuel; and/or the tubes forming the screen also form a vertical wall comprising one wall of the drying shaft, serving to separate it from the combustion chamber; further, the tubes forming the vertical wall may be bent to the sides in the plane of the wall and pass through the lateral walls of the furnace where they are connected to supply headers thereby defining an opening facing the distribution shelf for the admission of the deflected fuel.

The invention further includes the method of improving the efficiency of a steam generating furnace fired with high moisture content fuel which comprises providing a drying shaft parallel to and offset from the combustion chamber of the furnace; introducing the wet fuel into the upper portion of this shaft; permitting a portion of the hot products of combustion gases from the upper portion of the combustion chamber to flow into the upper portion of the shaft to evaporate moisture from the fuel and be cooled thereby so as to increase in density and fall by gravity within the shaft for recirculation into the lower portion of the combustion chamber, and deflecting and distributing the at least partially dried fuel from the bottom of the shaft into the lower portion of the combustion chamber along with the recirculated gases.

Further objects, features and advantages of the invention will be apparent from the following description of a preferred embodiment thereof taken in conjunction with the accompanying drawings.

DESCRIPTION OF PREFERRED EMBODIMENT

Figure 1:
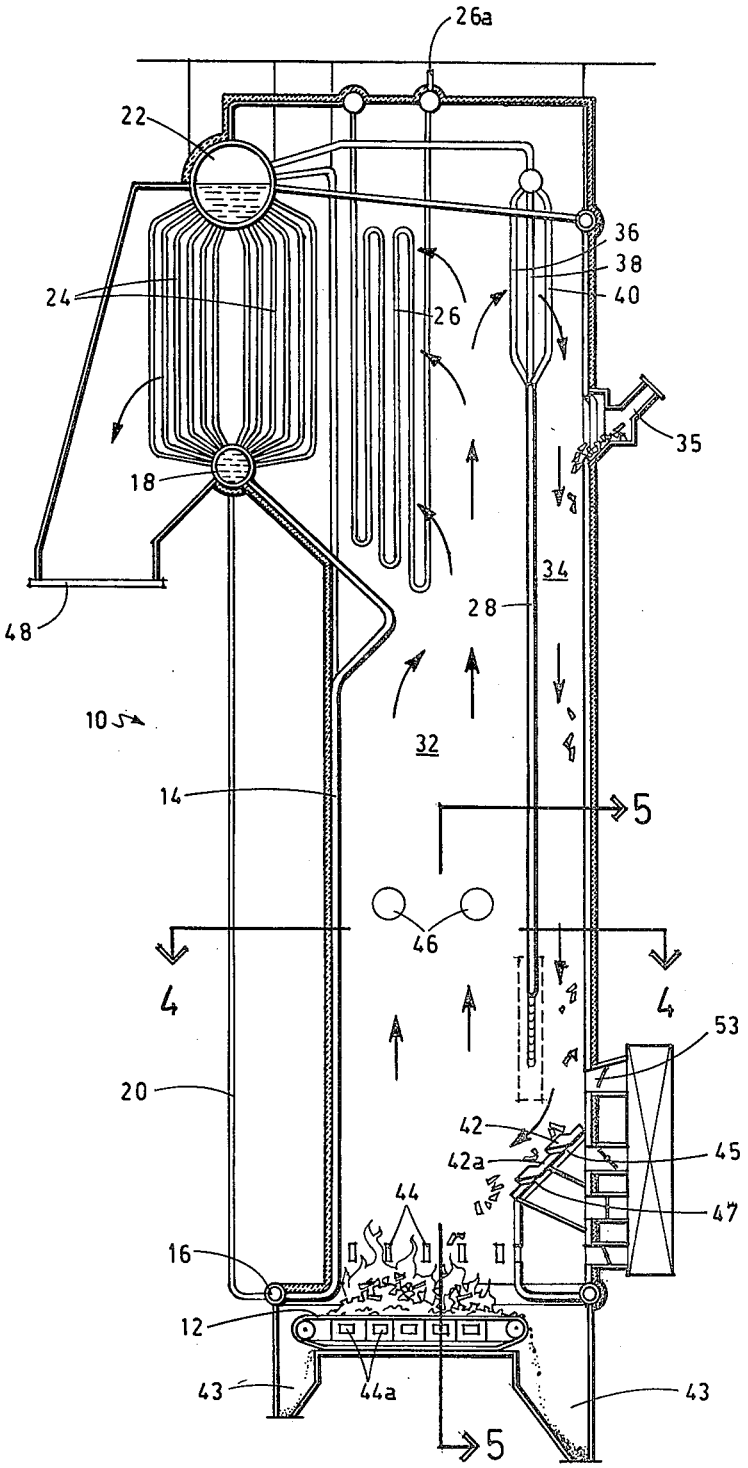
FIG. 1 is a vertical sectional side view of a waste wood fired, steam generating furnace of traditional combustion type embodying the invention.

As shown in FIG. 1, the waste wood fired steam generating furnace 10 includes a drying shaft 34 offset from a combustion chamber 32 having a traveling grate 12 on which the wood is burned. The combustion chamber is preferably lined with water cooled tubes 14 which are supplied by ring headers 16. Headers 16 receive water from the lower drum 18 through a down comer 20. A mixture of steam and water exits from the upper ends of tubes 14 into the drums 22 and 18. Steam is also generated in the boiler section 24 of the unit. The steam is discharged from drum 22 to superheater 26, and from there flows to its ultimate point of use through outlet 26*a*.

Figure 2:
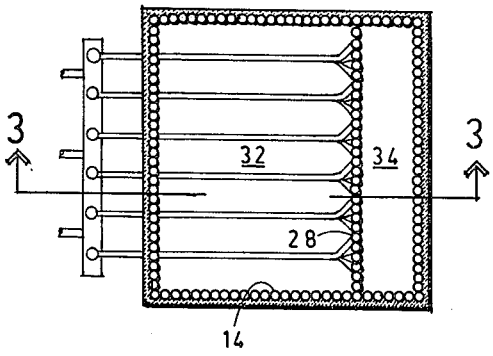
FIG. 2 is a horizontal cross-section of the steam furnace taken on line 2—2 of FIG. 3 showing the relationship of the combustion chamber to the drying shaft.
Figure 4:
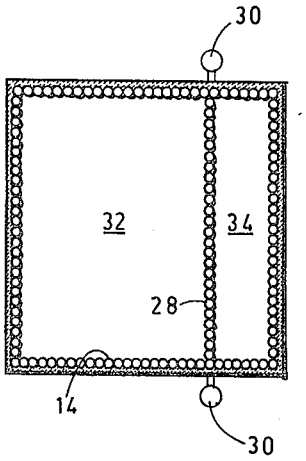
FIG. 4 is a horizontal cross-section taken on line 4—4 of FIG. 1.
Figure 3:
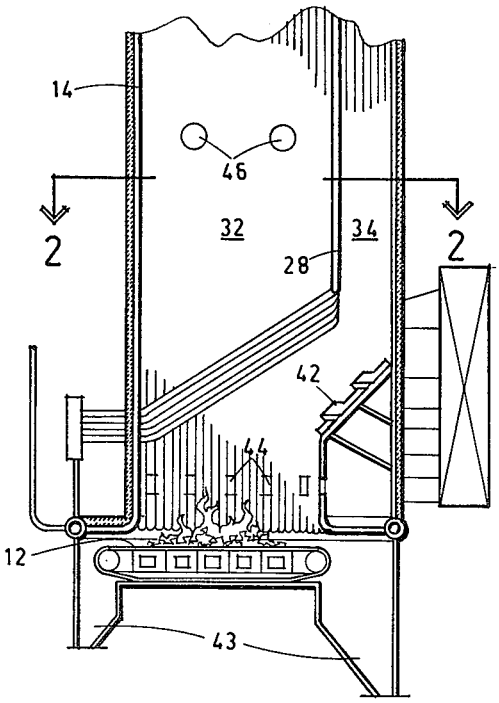
FIG. 3 is a sectional side view of the lower portion of the furnace taken on line 3—3 of FIG. 2.
Figure 5:
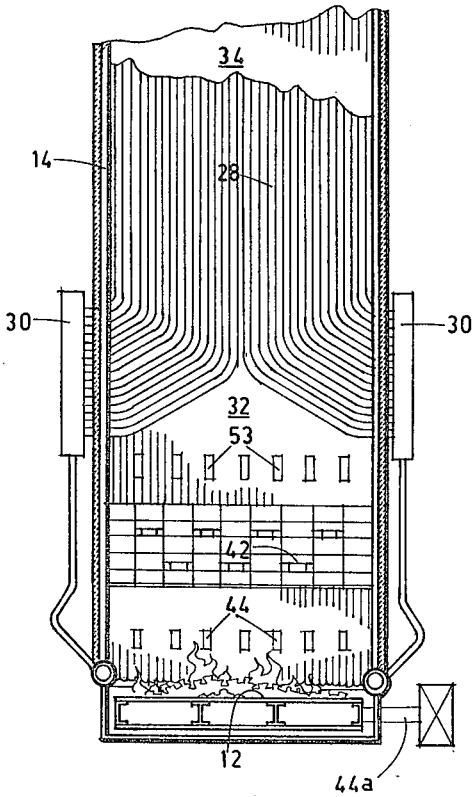
FIG. 5 is a vertical sectional view taken on line 5—5 of FIG. 1.

Additional steam is generated in tubes 28, which tubes receive water from lower headers 30, as shown in FIG. 5. The steam and water mixture flows through tubes 28 to the upper drum 22. Tubes 28 form a screen across the main furnace flow path (FIGS. 2 and 3), and are bent and fastened together, as by welding or by webs, so as to form a panel or wall (FIG. 1), dividing the furnace interior into two vertical passageways defining a combustion chamber 32 and a drying shaft 34 (FIGS. 1, 2 and 3). The screen across the furnace flow path prevents heat radiation from the furnace onto the grate 12, if auxiliary fuel is being burned in the auxiliary fuel burners 46 (FIG. 1). This reduces grate maintenance. At their upper ends, tubes 28 are separated and bent out of the single plane into three planes, 36, 38 and 40, to form a passageway between the upper portions of shafts 32 and 34. As seen in FIGS. 4 and 5, the lower portions of tubes 28 are bent to the sides in the plane of wall 28 to define a fuel admitting opening opposite ledge 42.

The waste wood is introduced into the upper end of drying shaft 34 through ports 35, and falls through shaft 34 toward the grate 12. Some of the falling pieces of waste wood hit and are deflected by the inclined surface of ledge 42, before being disbursed above or falling the remaining distance onto the upper run of the traveling grate 12. The exposed surface of the ledge is protected by suitable wear and heat resistant castings 42*a*. The grate can travel in either direction, as desired. Ashes are discharged from the grate 12 into ash hoppers 43. Air is introduced above the grate 12 through ports 44, and additional air is introduced beneath the upper grate run through ports 44*a*. Firing of the wood can closely follow load changes of the unit by controlling the air flow to the various air introduction ports. Additional air is introduced just above and through the ledge 42 through any of ports 53, 45 and 47, and each can be separately controlled to distribute the fuel particles evenly on and above the grate 12. By proper air introduction, some of the fines can be burned in suspension above the grate thereby improving air flow through the resultant fuel bed.

Auxiliary fuel burners 46 are provided in the furnace, so that when there is insufficient waste wood to generate steam, the unit can be fired with an auxiliary fuel such as gas or oil. Air can also be introduced through burners 46, to further support combustion of the waste wood. The combustion gases, after giving up most of their heat to the heating absorbing surfaces, are exhausted from the furnace through duct 48.

The following describes the operation of the novel furnace. Waste wood is burned on and above the grate 12, with the combustion gases flowing upwardly through the combustion chamber 32. Of the order of 75% to 80% of the combustion gases flow to the furnace outlet 48 from the top of the passageway 32, passing over the superheater surface 26 and boiler surface 24, before being discharged. The other approximately 20% to 25% of the hot gases flow to the right (as seen in FIG. 1), through the separated tubes 36, 38 and 40, into the upper end of the drying shaft 34. High-moisture content waste wood is introduced into the upper end of the drying shaft 34 through ports 35. The hot gases entering the drying shaft contact the wet fuel and in so doing some of the heat in the gases causes water to evaporate from the fuel which reduces the temperature of the gases thereby increasing the density of the gases in the drying shaft relative to those in the furnace and causing them to flow by gravity toward the bottom of the shaft.

In a typical example, the temperature of the gas passing into the drying shaft is 1700° F. and the fuel fall is 70 feet. Under these conditions, approximately one-half pound of water would be evaporated per pound of dried fuel. In effect, then, a fuel having a 60% water content at the feed point will be dried to a 50% water content as it leaves the drying shaft. If the entering fuel has a water content of 55%, then the fuel will be dried to a 42% water content. To obtain these conditions about 20% to 25% of the furnace gas must be recirculated through the drying shaft 34.

Gas recirculation through the drying shaft 34 is caused by the difference in density between the gases in the combustion chamber 32 and those in the drying shaft 34. The gases in the drying shaft 34 are cooled by contact with the wet fuel and the resultant average temperature in the shaft is much less than the average temperature of the gas in the main furnace passageway 32. The hot lower density furnace gas flows upwardly in the combustion chamber while the cooled denser gas flows downwardly in the drying shaft. This is quite similar to forces that cause water flow in a natural circulation boiler. It should be noted that the gas recirculation is essentially self-regulating. The more wet fuel that is fed into the drying shaft, the cooler the gas becomes, and the greater the recirculation. For any given set of conditions the size and height of the drying shaft must be set to take into account the gas temperature and the desired water evaporation from the fuel.

While there has been shown and described a presently preferred embodiment for practicing the invention it will nevertheless be understood that the same is meant to be by way of illustration and not by way of limitation. It is intended that the scope of the invention be limited only by the proper interpretation to be afforded the appended claims.

I claim:

1. In a steam generating furnace having a combustion chamber for burning high moisture content fuel comprising a vertical passageway arranged above a fuel burning grate for upward flow therein of the products of combustion, the improvement permitting at least partial pre-drying of high moisture content fuel fed to said grate comprising means forming a second passageway comprising a drying shaft arranged generally parallel to said first-named passageway;

means establishing communication between the upper end portions of said passageways so as to divert some of the upwardly flowing hot gaseous products of combustion from the upper portion of said combustion chamber into the upper portion of said drying shaft;

means providing an opening between the lower end portions of said passageways above the level of said grate, said drying shaft being sufficiently offset from said first-named passageway to prevent upward flow therein of products of combustion from said combustion chamber;

means for introducing the high moisture content fuel into said drying shaft near its upper end so that it will fall downwardly therein by gravity whereby moisture is evaporated from the fuel thereby cooling and increasing the density of the diverted gases to induce downward flow by gravity thereof along with the falling fuel; and a ledge mounted in the lower end portion of said drying shaft facing said opening at a level above that of said grate, said ledge providing a downwardly inclined surface exposed to the falling fuel for deflecting it through said opening into said combustion chamber for burning on and above said grate, the cooled gases being recirculated to said combustion chamber through said opening;

said means establishing communication between the upper end portions of said passageways being located at a level above the burning fuel to further induce flow of the diverted gases.

2. A furnace according to claim 1, including air ports located above said ledge through which air can be introduced for causing even distribution of the fuel onto and above said grate.

3. A furnace according to claim 2, including air ports for introducing additional fuel distributing air through said ledge.

4. A furnace according to claim 1, including a screen formed of spaced heat exchange tubes extending across the combustion chamber and burners located above the screen for burning auxiliary fuel.

5. A furnace according to claim 4, wherein the tubes forming the screen also form a vertical wall comprising one wall of said drying shaft, serving to separate it from said combustion chamber.

6. A furnace according to claim 5 wherein the tubes forming the vertical wall are bent to the sides in the plane of the wall and pass through the lateral walls of the furnace for connection to supply headers thereby defining an opening facing said ledge.

* * * * *